United States Patent [19]

Ito et al.

[11] 4,269,500

[45] May 26, 1981

[54] TROUBLE DETECTING SYSTEM FOR ELECTROPHOTOGRAPHIC COPYING MACHINE

[75] Inventors: Masazumi Ito, Toyokawa; Kenji Shibazaki, Aichi; Tsuneo Kitagawa, Toyohashi, all of Japan

[73] Assignee: Minolta Camera Kabushiki Kaisha, Osaka, Japan

[21] Appl. No.: 101,250

[22] Filed: Dec. 7, 1979

[30] Foreign Application Priority Data

Dec. 29, 1978 [JP] Japan ..... 53-164356

[51] Int. Cl.[3] ..... G03G 15/00

[52] U.S. Cl. ..... 355/14 C; 355/3 SH

[58] Field of Search ..... 355/67, 69, 14 C, 14 R, 355/8, 15, 3 SH

[56] References Cited

U.S. PATENT DOCUMENTS

| | | | |
|---|---|---|---|
| 3,914,047 | 10/1975 | Hunt, Jr. et al. | 355/14 C |
| 4,139,300 | 2/1979 | Katayama et al. | 355/14 C |
| 4,186,299 | 1/1980 | Batchelor | 355/14 C |
| 4,203,663 | 5/1980 | Ogura et al. | 355/14 C |

*Primary Examiner*—Richard A. Wintercorn

*Attorney, Agent, or Firm*—Wenderoth, Lind & Ponack

[57] ABSTRACT

A trouble detecting system is incorporated in an copying machine having an illumination lamp for projecting light beams onto an original, optical path for transmitting the reflected light beams from the original onto a photoreceptor surface and a scanning device for scanning the original. The trouble detecting system includes a first detector which is disposed along the scanning path of the lamp for detecting the scanning movement of the lamp and a second detector which is coupled with a driving motor for driving the scanning device for detecting the actuation of the driving motor.

5 Claims, 5 Drawing Figures

TROUBLE DETECTING SYSTEM FOR ELECTROPHOTOGRAPHIC COPYING MACHINE

BACKGROUND OF THE INVENTION

The present invention generally relates to an electrophotographic copying machine and, more particularly, to a system for detecting a trouble occurring in a scanning mechanism which is used in the electrophotographic copying machine to enable a document or original to be optically scanned.

In currently utilized electrophotographic copying machines, an image of the document or original to be reproduced is transferred to an electrophotosensitive member by means of an optical transfer system. The optical transfer system generally comprises an illuminator including an electric lamp for illuminating the original imagewise which is then placed on a transparent support plate, and an optical path for directing the light which carries the image of the original and which has been reflected from the original, towards the electrophotosensitive member. Depending on the manner by which the original is illuminated, the currently utilized electrophotographic copying machines can be classified into two types; one type wherein the transparent support plate is moved together with the original thereon relative to the illuminator and the other type wherein the illuminator is moved relative to the transparent support plate.

In either type of the electrophotographic copying machines, a scanning mechanism including an electrically operated motor and a drive transmission device for transmitting the drive of the motor to the illuminator or the transparent support plate is essentially employed in order to enable the illuminator to scan the original imagewise. It often happens that, when any abnormal condition occurs in the scanning mechanism while the other parts of the electrophotographic copying machine function satisfactorily, the transparent support plate or the illuminator will not move properly while the lamp remains lit. In the worst it may happen, this may result in excessive heating of a local area of the transparent support plate to such a temperature as may cause an operator of the machine to suffer from a burn when to touch the transparent support plate or as may cause the cracking or breakage of the transparent support plate which is generally constituted by a transparent plate glass. In particular, the longer the time during which the lamp remains lit without being turned off simultaneously with the failure of the scanning mechanism to operate, the higher the possibility of these calamities.

In general, the failure of the scanning mechanism to operate properly may be considered as attributable to either a breakdown of the drive motor or a breakdown of the drive transmission mechanism even though the drive motor is satisfactorily functioning. However, in order to avoid the occurrence of one or all of the calamities described above, it is necessary to detect the occurrence of the abnormal condition irrespective of the cause of the failure of the scanning mechanism to operate properly, substantially simultaneously with or immediately after the occurrence of such abnormal condition.

Unfortunately, none of the currently utilized electrophotograhic copying machines is equipped with any trouble detecting system designed particularly for detecting the breakdown occurring in the scanning mechanism. Although the breakdown of the drive motor of the scanning mechanism used in the prior art electrophotographic copying machines can readily be detected by ascertaining that no other electrically operated parts of the copying machine to be suquentially operated subsequent to the start of operation of the drive motor of the scanning mechanism operate, no breakdown of the scanning mechanism can readily be detected for a prolonged period of time before the sequence of operation of various movable parts of the copying machine shows an abnormal condition occurring in the scanning mechanism. This prolonged period of time would be such an extent as to result in one or all of the calamities due to the excessive heating of the local area of the transparent support plate in the manner described above.

SUMMARY OF THE INVENTION

Accordingly, it is a primary object of the present invention to provide a trouble detecting system for detecting any possible trouble occurring in the scanning mechanism, thereby substantially eliminating the above described disadvantages and inconveniences inherent in the prior art electrophotographic copying machines.

It is another object of the present invention to provide the trouble detecting system of the above described type, the operation of which is controlled by a microcomputer.

It is a further object of the present invention to provide the trouble detecting system of the above described type which is simple in construction and can readily be manufactured at low cost.

In accordance with a preferred embodiment of the invention, a trouble detecting system is incorporated in an electrophotographic copying apparatus having a support for placing an original which is illuminated by light beam projected from an illumination means. The reflected light beam from the original carrying an image information is transmitted to a photoreceptor surface through an optical transmitting means. The electrophotographic copying apparatus further includes means for scanning the original by the illumination means and means for driving the scanning means. The trouble detecting system according to the present invention comprises a pulse generating means for generating pulse signal in response to the actuation of the driving means and means for generating a starting signal for starting actuation of the scanning means. The action of the scanning means is detected by a first detecting means which produces a first detect signal when the scanning means is actuated a predetermined degree from its initial position. The generation of the pulse signal from the pulse generating means is detected by a second detecting means which produces a second detect signal in response to a level change in the pulse signal. A first timer means is provided for counting a first predetermined period of time in response to the starting signal. This first predetermined period of time is longer than a period of time necessary for the scanning means to scan from its initial position to the predetermined degree. A second timer means is provided for counting a second predetermined period of time in response to the starting signal. This second predetermined period of time is longer than the pulse duration of the pulse signal. The trouble detecting system further comprises means response to the breakdown of the scanning means for generating a first warning signal when the first detecting means produces no first detect signal within said first predetermined period of time and a second warning signal when the second detecting means produces no second detect signal with the second predetermined period of time.

BRIEF DESCRIPTION OF THE DRAWINGS

These and other objects and features of the present invention will become apparent from the following description taken in conjunction with a preferred embodiment thereof with reference to the accompanying drawings, in which.

DETAILED DESCRIPTION OF THE INVENTION

Figure 1:
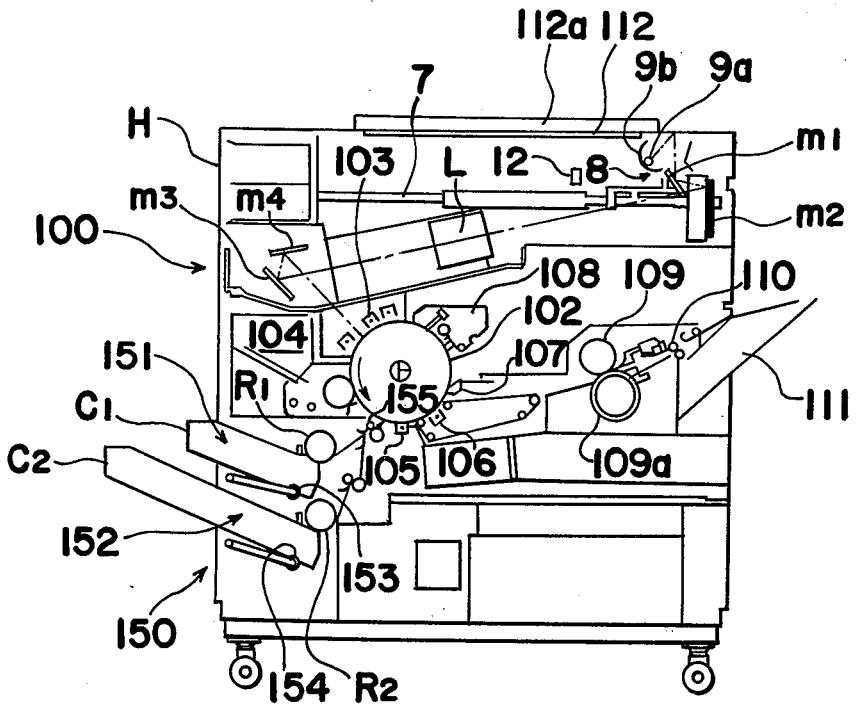
FIG. 1 is a schematic side sectional view of an electrophotographic copying apparatus incorporated with a trouble detecting system of the present invention.

Before the description of the present invention proceeds, it should be noted that like parts are designated by like reference numerals throughout the accompanying drawings.

Referring to FIG. 1, there is shown an electrophotographic copying machine 100 comprising a housing structure substantially divided into upper and lower compartments; the upper compartment accommodates therein an optical system while the lower compartment accommodates therein an electrophotographic processing system. The housing structure is generally designated by a reference character H and has a transparent support 112 stationarily mounted on the top of the housing structure H, and a cover member 112*a* pivotally provided at the edge of the support 112. The transparent support 112 is made of, for example, a transparent glass plate, and is adapted to support the original or document to be copied thereon and the cover member 112*a* is adapted to press the original against the support 112. The optical system will be described in detail later, whereas the processing system will now be described.

The electrophotographic processing system and the method performed thereby are well known to those skilled in the art and, therefore, the various operating elements thereof will be described in terms of their functions.

The electrophotographic copying system comprises a photoreceptor surface, generally indicated by a reference numeral 102, including a photoconductive layer or light receiving layer on a conductive backing and formed in the shape of drum, which is mounted on a shaft (not shown) journaled in a machine frame (not shown) so as to rotate in the direction indicated by the arrow to cause the drum surface sequentially to pass a plurality of processing stations including charging, exposure or imaging, developing, transfer and cleaning stations.

The charging station includes a corona charger 103 which applies a uniform electrostatic charge on the photoreceptor surface 102. Positioned next to and adjacent to the charging station with respect to the direction of rotation of the photoreceptor surface 102 is the exposure or imaging station at which rays of light carrying an image of the original, which have been transmitted from the transparent support 112 by the optical system, as will be described later, in the form of a ribbon of light, are projected onto the photoreceptor surface 102 to dissipate the electrostatic charge in the exposure area thereof thereby forming a latent electrostatic image of the original.

Positioned next to the exposure station is the developing station having a developing device 104. At the developing station, the latent image on the photoreceptor surface 102 is developed into a visible image by the supply of toner particles in the known manner from the developing device 104.

Below and on the left-hand side of the drum 102, there is provided a paper feeding station including paper feeding mechanism adapted to feed sheets of recording medium, for example, copy paper, successively to the transfer station in coordination with the presentation of the toner image at the developing station. The paper feeding mechanism comprises an upper cassette loading unit 151 provided for loading a cassette C1 carrying small size sheets of papers and a lower cassette loading unit 152 provided for loading a cassette C2 carrying large size sheets of papers. The upper cassette loading unit 151 has a lever supported roller 153 which raises up an inserted end portion of the inserted cassette C1 for allowing a contact between a paper baring from front upper portion of the cassette C1 and a roller R1. When the roler R1 rotates, the sheets of papers in the cassette C1 are drawn out one at a time towards the transfer station. Similarly, the lower cassette loading unit 152 has a lever supported roller 154 for raising the cassette C2 towards a roller R2 for drawing out the sheets of papers one at a time towards the transfer station. A selecting switch (not shown) is provided for allowing the actuation of either one of the rollers R1 and R2 in sequence of each copying operation. The paper feeding mechanism further comprises a timing roller 155 which temporarily stop the drawn paper and feeds the paper to the photoreceptor surface 102 in an appropriate sequence controlled by a synchronizing signal. It is to be noted that since the upper cassette loading unit 151 is positioned closer to the timing roller 155 than the lower cassette loading unit 152 the synchronizing signal for controlling the sequence of upper cassette loading unit 151 is different from the signal for controlling the sequence of lower cassette loading unit 152. These synchronizing signals are controlled by a microcomputer which will be described in detail later.

At a transfer station, the paper drawn from either one of the cassettes C1 and C2 is pressed against the photoreceptor surface 102 for receiving particles of the toner image on the photoreceptor surface which are transferred onto such copy paper by a transfer charger 105. A charge eraser 106 is positioned next to the transfer charger 105 for erasing or discharging the charge on the photoreceptor surface 102.

Thereafter, the paper is removed from the photoreceptor surface 102 by a peeling craw 107 and it is conveyed to a fixing device including heat roller 109 which is held in contact with a neighboring roller 109*a*. When the copy paper passes between the rollers 109 and 109*a*, the toner image is fixed on the paper. The copy paper is then ejected from the copying machine into a copy tray 111 through juxtaposed discharging rollers 110 provided between the fixing device and the copy tray 111.

The photoreceptor surface 102, from which the transferred sheet has been separated by the peeling craw 107, is subsequently transported during its continual rotation to the cleaning station. The cleaning station includes a cleaning unit 108 which removes the residual toner particles remaining on the photoreceptor surface 102 in readiness for the subsequent cycle of the copying operation. For this purpose, the cleaning station is generally located preceding the charging station.

Figure 3:
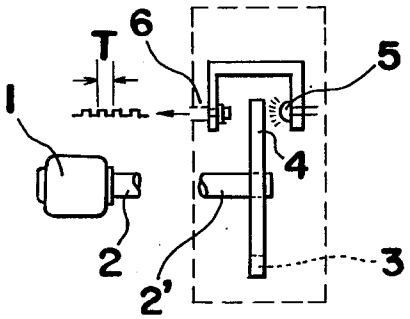
FIG. 3 is a schematic diagram showing a pulse generator.
Figure 4:
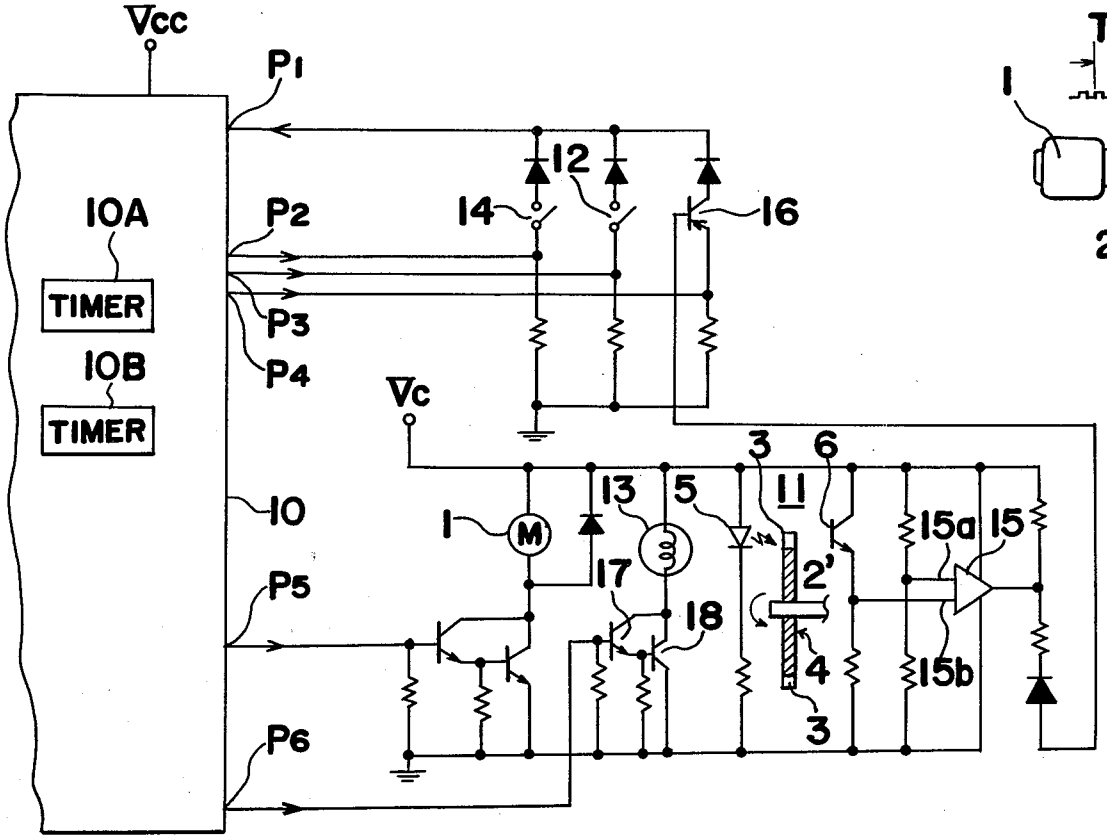
FIG. 4 is a circuit diagram connected to the microcomputer.

Still referring to Fig. 1, the optical system of the electrophotographic copying machine, further includes optical system which is substantially accommodated within the upper compartment of the machine housing H, comprises an illumination device 8 including a source of lamp 9*a*, a reflector 9*b*, a first mirror ml and a second mirror m2 which are movably mounted on a shaft 7. The image-wise light emitted from the light source 9*a* can be projected towards the original on the transparent support 112 in the shape of a ribbon of light to sequentially illuminate the original as the illumination device 8 is moved from its initial position as shown in FIG. 1 to a scanned position over the original along the shaft 7 by a scanning means driven by a driving motor 1 (FIGS. 3 and 4). One type of scanning means is disclosed in Ikeda et al's U.S. Pat. No. 4,125,323 issued Nov. 14, 1978. The optical system further comprises third and fourth mirrors m3 and m4 which are rigidly held in the upper compartment and a lens assembly L positioned between the second and third mirrors m2 and m3. The image-wise light reflected from the second mirror m2 is transmitted through the lense assembly L, to the mirrors m3 and m4 and is, in turn, projected onto the photoreceptor surface 102 at a predetermined angle of incidence to form the latent image of the original, as the drum rotates in relation to the movement of the illumination device 8.

Positioned along the path of movement of the illumination device 8 is a micro-reed switch 12 which is actuated when the illumination device 8 during its scanning action moves past the switch 12.

Figure 2:
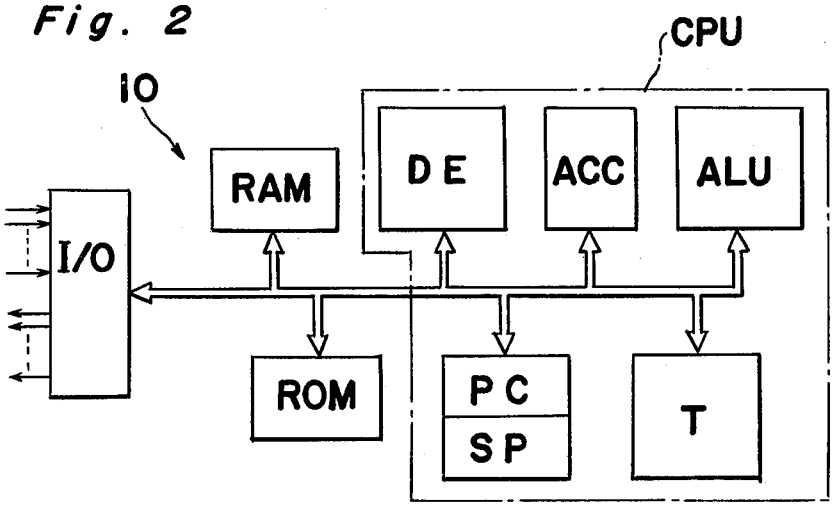
FIG. 2 is a block diagram of a microcomputer used for the trouble detecting system of the present invention.

Referring to FIG. 2, a microcomputer designated by a reference numeral 10 is incorporated in the electrophotographic copying machine 100 for controlling various sequence of operations carried out at a number of stations and by various devices. The microcomputer 10 comprises a central processing unit CPU, a random access memory RAM and a read only memory ROM which are connected to an input and output interface I/O and are constructed by one or more chips of large scale integrated circuits (LSI). The central processing unit CPU includes an arithmetic-logic unit ALU, and accumulator ACC, a decoder DE, a program counter PC, a stack point SP and a timer T.

The sequence control signal for each of the devices in the copying machine is generated in accordance with a program memorized in the read only memory ROM while a timing in which the read only memory ROM generates the sequence control signal is determined by the number of pulses counted in the counter. These pulses are produced from the timer T. Although the central processing unit CPU further includes flags F/F and a number of working registers, they are omitted in the drawings for the sake of brevity.

In the above described copying machine, the illumination device 8 scans the original for transmitting the image of the original onto the photoreceptor surface 102. If, during the scan of the illumination device 8, the scanning means goes out of order and fails to operate correctly, the illumination device 8 stops scanning and directs the light from the lamp 9*a* on the same place in the transparent support 112, causing a partial temperature increase in the support 112. by this undesirable temperature increase, the support 112 can be cracked or the operator may be injured. The cause of this trouble in the scanning means can be considered as:

(1) a breakdown in a driving force transmitting means connected between the motor 1 and the illumination device 8; or (2) a breakdown in the motor 1.

Generally, for the purpose of sequential control of the scanning means and other devices in the copying machine 100, a shaft 2' of working device carries a revolution detecting means. The shaft 2' is connected, through a suitable clutch means such as an electromagnetically driven clutch, to a shaft 2 of the motor 1.

The revolution detecting means includes a disc 4 rigidly mounted on the shaft 2'. The disc 4 has slits or perforations 3 around its peripheral portion positioned side-by-side with each other at a predetermined pitch. A light source such as a light emitting diode 5 and a light receiving element such as phototransistor 6 for receiving light from the diode 5 are positioned on the opposite sides of the disc 4 in such a manner that the light from the diode 5 is intermittently transmitted to the phototransistor 6 during the rotation of the disc 4 through the slits 3. Accordingly, the phototransistor 6 generates a train of pulses having a frequency determined by the speed of revolution of the disc 4. In this sense, the revolution detecting means can be considered as a pulse generating device. This pulse signal is generally applied to the computer for controlling the sequence of copying operation.

In the copying machine employing the above described type of control system, the trouble in the scanning means caused by the breakdown of the motor 1 results in stop of rotation of the disc 4. Thus, the phototransistor 6 stops generating the pulse signal. From this point of view, it is suspected that the detection of breakdown in the motor 1 can be carried out by the detection of pulse signal from the phototransistor 6.

However, in a general control system employing microcomputer, whether the motor is in normal condition or not is not detected by the presence and absence of the pulse generated from the phototransistor 6 but by the signal lever from the phototransistor 6 at a particular moment. In other words, if the detected signal from the phototransistor 6 is high, the computer determines that the motor 1 is normally operating, and if the detected signal is low, the computer determines that the motor 1 is out of order. Therefore, if the breakdown of the motor 1 should stop the disc 4 at such a position that the slit 3 is positioned in the way between the light emitting diode 5 and the phototransistor 6, the phototransistor 6 continually produces a high level signal. In this case, the computer erroneously determines that the motor 1 is normally operating.

If the detection of the motor condition is carried out by the presence and absence of the pulse signal, it is necessary to examine the output signal from the phototransistor 6 for a time duration sufficient to discriminate the repetition of the pulse. A device for carrying out the above detection would be complicated in structure and requires a high manufacturing cost.

Figure 5:
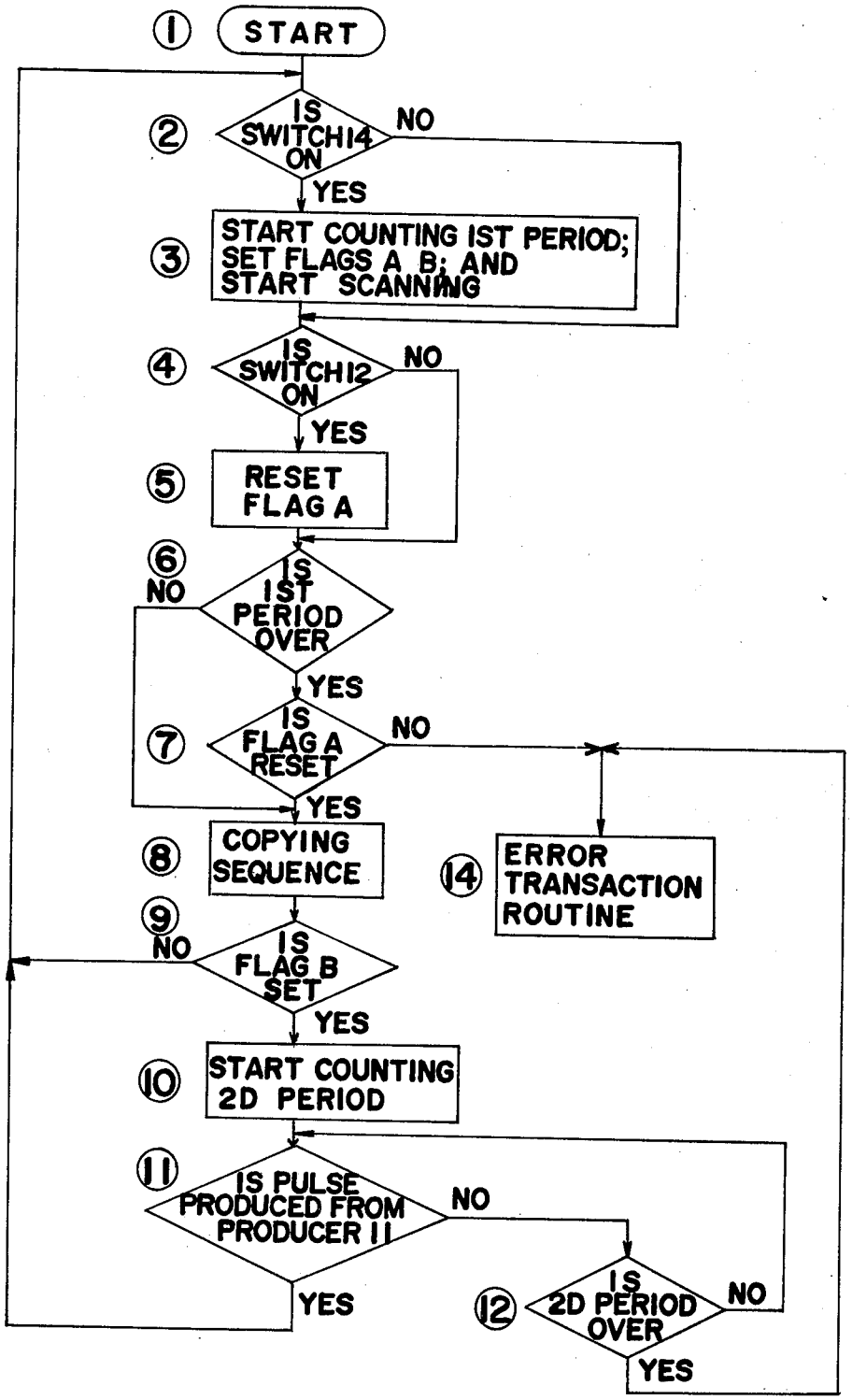
FIG. 5 is a flow chart showing steps for detecting the trouble in the scanning means.

Referring to FIG. 4, a connection between the microcomputer 10 and a circuit for controlling the copying operation, particularly, the scanning operation is shown. In the circuit of FIG. 4, the reference numeral 11 designates the pulse generator shown in FIG. 3, the reference numeral 12 designates the micro-reed switch provided at a fixed location along the path of illumination device 8. The micro-reed switch 12 is actuated when the illumination device 8 scans or is moved a predetermined distance from its initial position. A reference numeral 13 designates a warning lamp and a reference numeral 14 designates a print switch for starting the copying operation when the switch 14 is turned on. The microcomputer 10 has the read only memory ROM memorizing various programs such as: program for carrying out the copying operation with a predetermined sequence; program for setting a predetermined time in first and second timers 10A and 10B; and a program, as shown in FIG. 5, for detecting the trouble in the scanning means.

When the scanning means is in the normal condition, the actuation of the driving motor 1 turns the disc 4. When the slit 3 appears in the optical path between the light emitting diode 5 and the phototransistor 6, a high level signal is generated from the phototransistor 6. This high level signal is applied to an input **15*b* of a comparator 15. The other input 15*a* of the comparator 15 is applied with a reference voltage which is smaller than the generated high level signal. Accordingly, the comparator 15 produces a high level signal in response to the high level signal applied to its input 15*b*. The high level signal from the comparator 15 turns a transistor 16 on for allowing a transmission of signal from an output P4 of the computer 10 to an input P1 of the same. The receipt of signal at the input P1 informs the computer 10 that the slit 3 in the disc 4 is now moving across the optical path between the diode 5 and the phototransistor 6**.

On the other hand, when the disc 4 is rotated to bring the solid portion of the disc 4 in the way of optical path between the diode 5 and the phototransistor 6, the comparator 15 produces a low level signal. Therefore, the transistor 16 is held non-conductive state for preventing the transfer of signal from the output P4 to the input P1. The receipt of low level signal to the input P1 informs the computer 10 that the solid portion of the disc 4 is now moving across the optical path. In this manner, the phototransistor 6 generates pulse signal which is taken into the microcomputer 10 as a reference pulse signal for controlling the timing or sequence of various devices incorporated in the copying machine.

A signal generated by the closure of the switch 12 is applied to the input P1 to detect whether the scanning means is in the normal condition or not in the program described below.

The description will now be directed to the program for detecting trouble in the scanning means. However, because programming of microcomputer is a conventional skill, the particular details of the program will not be given. The following disclosure would enable a programmer having ordinary skill in the art to produce an appropriate program for the computer 10. The particular details of any such program would, of course, depend upon the architecture of the selectable computer.

When the print switch 14 is turned on, a signal is produced from an output P2. This signal is applied to the input P1 for causing the first timer 10A to start counting a first period of time. The first period of time is slightly longer than a period of time necessary for the illumination device 8 to move from its initial position to an actuating position for actuating the switch 12. The signal applied to the input P1 is also used for setting "1" in flags A and B in the microcomputer 10. In addition, the closure of the print switch 14 causes actuation of the illumination device 8 and actuation of the scanning means. Accordingly, the lamp **9*a* is turned on and the illumination device 8 is scanned along the document on the support 112. In the normal condition, the scanning action of the illumination device 8 turns the switch 12 on within the first period of time for applying a signal from a port P3 to the port P1. Thereafter, in a step 4 (indicated by "4" in FIG. 5. Other steps are indicated similarly.) it is discriminated whether the switch 12 is on or not by the central processing unit CPU. If the answer to this discrimination is "YES", the procedure advances to a step 5 in which the flag A is reset to "0". Then, in the step 6, it is discriminated whether the first period is over or not by the timer 10A. In the normal operation, the illumination device 8 actuates the switch 12 within the first period. Thus, the procedure advances to a step 8 in which various copying operations such as application of charge on the photoreceptor surface 102, driving of rollers for supplying copy paper to the transfer station, etc., are sequentially carried out in accordance with a program. Thereafter, the state of the flag B is examined. If the flag B is in the reset state carrying "0", the procedure returns back to the step 2. On the other hand, if the flag is in the set state carrying "1", the procedure advances to a step 10. In the step 10 the second timer 10B is actuated to start counting a second period of time. Then, in a step 11, it is descriminated whether the pulse generating device 11 is generating the pulse or not. In this case, it is discriminated as "YES" if the input P1 receives a high level signal and "NO" if the input P1 receives a low level signal. In the case where the answer from the step 11 is "YES", the procedure returns back to the step 2** for repeating another cycle of operation. Thus, the copying operation is carried out without any interruption.

Next, a case wherein the scanning means has a trouble particularly caused by the breakdown in the driving force transmitting means connected between the motor 1 and the illumination device 8 is described. Since the driving motor 1 is in the normal condition, a signal from an output P5 runs the motor 1 for generating the reference pulse signal from the pulse generator 11. However, since the driving force transmitting means is broken, the illumination device 8 is maintained in its initial position regardless of actuation of the driving motor 1. Therefore, the switch 12 will not be actuated within the first period of time.

In the above described trouble, the computer 10 follows a first trouble detecting procedure described below.

In the step 3, the timer 10A starts counting the first period of time while the flags A and B are set to "1". Since the switch 12 is not turned on, the answer to the discrimination in the step 4 is "NO". Therefore, the procedure skips the step 5 and advances to the step 6 maintaining the flag A in the set condition. In the step 6, it is discriminated whether the timer 10A has counted the first period or not. If the timer 10A has counted the first period, the procedure advances to a step 7 for carrying at a discrimination whether the flag A is reset or not. Since in this procedure, the flag A is still in the set condition, the procedure advances to "NO" which leads to a step 14 for producing an error operation signal. When the error operation signal is produced, it is taken out from an output P6 and is applied to a transistor 17 which then turns a transistor 18 on for actuating a warning lamp 13. In addition, the error operation signal is utilized for stopping the copying operation particularly for turning off the lamp 9*a*.

Next, a case wherein the scanning means has a trouble particularly caused by the breakdown of the motor 1 is described. Since the breakdown of the motor 1 stops the revolution of the shaft 2', the disc 4 is either held in a blocking condition in which the light passage between the light emitting diode 5 and the phototransistor 6 is blocked by the solid portion of the disc 4 or a transmitting condition in which the light emitted from the light emitting diode 5 is transmitted through the slit 3 to the phototransistor 6. When the disc 4 is in the transmitting condition, the phototransistor 6 produces a high level signal to the comparator 15 for allowing electrical connection between the output P3 and the input P1. On the other hand, when the disc 4 is in the blocking condition, the phototransistor 6 produces a low level signal to the comparator 15 for intercepting the connection between the output P3 and the input P1.

In the case where the disc 4 is held in the transmitting condition, the computer 10 follows the same procedure as the first trouble detecting procedure described above.

On the other hand, in the case where the disc 4 is held in the blocking condition, the computer 10 follow the same procedure as the first trouble detecting procedure but only up to the step 10. In the step 11, it is discriminated that the output signal from the phototransistor 6 is a low level signal indicating no producton of pulse from the generator 11. Accordingly, the procedure advances to "NO" which leads to a step 12. In the step 12, it is discriminated whether the timer 10B has counted a second period or not. If the answer to this discrimination is "NO" the procedure repeats the step 11 until the second period is over. Since the second period is prearranged to be a little longer than the normal pulse duration of the reference pulse, the answer "YES" should be produced from the step 11 within the second period of time if the reference pulse is produced normally. If the phototransistor 6 produces no reference pulse within the second period of time, the procedure of the step 12 directs to "YES" and further to the step 14 for producing the error operation signal. Thereupon, the computer 10 generates a warning signal in the same manner as described above for stopping the copying operation.

As apparent from the above description, the trouble in the scanning means caused by the breakdown of the driving motor 1 or by the breakdown of the driving force transmitting means is detected by the descrimination of condition of the switch 12 after the first period of time counted by the counter 10A and by the discrimination of condition of the pulse generator 11 whether it is producing a pulse after the second period of time counted by the counter 10B.

Furthermore, in the case where the trouble is particularly caused by the breakdown of the driving motor 1, the disc 4 may be stopped at either in the blocking condition or in the transmitting condition. In either condition, the computer detects no pulse generation from the generator 11 without any employment of particular pulse detecting means.

Moreover, since the trouble detecting system of the above described embodiment uses a microcomputer, the timers 10A and 10B for counting the first and second periods can be timers originally incorporated in the microcomputer. Therefore, for detecting trouble in the scanning means, all it is necessary is to provide the switch 12 in an appropriate position in the path of illumination device. Therefore, the structure is so simple that the trouble detecting system of the present invention can be readily incorporated in any conventional copying machines.

Although the present invention has been fully described by way of examples with reference to the accompanying drawings, it is to be noted that various changes and modifications are apparent to those skilled in the art. Therefore, such changes and modifications are, unless they depart from the true scope of the present invention, to be understood as included therein.

What is claimed is:

1. In an electrophotographic copying apparatus having a support for placing an original, illumination means for projecting light beam onto the original, optical transmitting means for transmitting an image of the original onto a photoreceptor surface, scanning means for scanning the original by the illumination means, and means for driving the scanning means, a trouble detecting system comprising:

pulse generating means for generating pulse signal in response to the actuation of the driving means;

means for generating a starting signal for starting actuation of the scanning means;

first detecting means for detecting the action of the scanning means and for producing a first detect signal when said scanning means is actuated a predetermined degree from its initial condition;

second detecting means for detecting the generation of the pulse signal from the pulse generating means and for producing a second detect signal in response to a level change in the pulse signal;

first timer means for counting a first predetermined period of time in response to the starting signal, said first predetermined period of time being longer than a period of time necessary for the scanning means to act from its initial condition to said predetermined degree;

second timer means for counting a second predetermined period of time in response to said starting signal, said second predetermined period of time being longer than a pulse duration of said pulse signal; and means responsive to the breakdown of the scanning means for generating a first warning signal when the first detecting means produces no first detect signal within said first predetermined period of time and a second warning signal when said second detecting means produces no second detect signal within said second predetermined period of time.

2. The invention as set forth in claim 1 further comprising means for disabling illumination means in response to the first and second warning signals.

3. The invention as set forth in claim 1 further comprising warning lamp responsive to said first and second warning signals.

4. The invention as set forth in claim 1, wherein said pulse generating means comprises a disc rigidly mounted on an axle connected to a shaft of said driving means, said disc having a plurality of slits formed in a radial direction around the peripheral edge portion of the disc with a predetermined pitch between neighboring two slits, a light emitting means positioned on one side of the disc facing one of slits, and a light responsive means positioned on the other side of the disc in alignment with the light emitting means for receiving the light transmitted through the slit.

5. The invention as set forth in claim 1 further comprises a microcomputer having first and second flags being set at the start of counting the first predetermined period of time, said first flag being reset in response to the first detect signal, said second timer being set after the set of the second flag, said first warning signal being produced when the first flag is in set condition after the first predetermined period of time and said second warning signal being produced when no pulse signal is produced within said second predetermined period of time.

* * * * *